US009142902B2

(12) United States Patent
Glick et al.

(10) Patent No.: US 9,142,902 B2
(45) Date of Patent: Sep. 22, 2015

(54) ELECTRICAL TERMINAL ASSEMBLY

(71) Applicant: Lear Corporation, Southfield, MI (US)

(72) Inventors: Michael Glick, Farmington Hills, MI (US); Slobodan Pavlovic, Novi, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/448,330

(22) Filed: Jul. 31, 2014

(65) Prior Publication Data

US 2015/0038024 A1 Feb. 5, 2015

Related U.S. Application Data

(60) Provisional application No. 61/860,991, filed on Aug. 1, 2013.

(51) Int. Cl.

| | |
|---|---|
| ***H01R 13/18*** | (2006.01) |
| ***H01R 13/187*** | (2006.01) |
| ***H01R 13/11*** | (2006.01) |
| ***H01R 43/16*** | (2006.01) |

(52) U.S. Cl.
CPC ..... *H01R 13/11* (2013.01); *H01R 13/18* (2013.01); *H01R 43/16* (2013.01)

(58) Field of Classification Search
CPC .... H01R 13/18; H01R 13/187; H01R 13/113; H01R 13/111
See application file for complete search history.

(56) References Cited

U.S. PATENT DOCUMENTS

| | | | | |
|---|---|---|---|---|
| 1,132,094 | A | 3/1915 | Hosford | |
| 2,774,951 | A | 12/1956 | Kinkaid et al. | |
| 2,921,287 | A | 1/1960 | Matthysse et al. | |
| 3,076,953 | A * | 2/1963 | Sloop | 439/857 |
| 3,550,069 | A | 12/1970 | Teagno | |
| 3,633,153 | A | 1/1972 | Ahmed | |
| 3,914,008 | A * | 10/1975 | Hollander et al. | 439/687 |
| 3,914,009 | A | 10/1975 | Chia et al. | |
| 4,040,713 | A | 8/1977 | Könnemann | |
| 4,351,583 | A | 9/1982 | Belttary | |

(Continued)

FOREIGN PATENT DOCUMENTS

| | | | |
|---|---|---|---|
| CN | 102034656 | A | 4/2011 |
| CN | 104009312 | A | 8/2014 |

(Continued)

OTHER PUBLICATIONS

Chinese 1st Office Action, Application No. 201010203667.3 dated Nov. 27, 2013.

(Continued)

*Primary Examiner* — Gary Paumen
(74) *Attorney, Agent, or Firm* — MacMillan, Sobanski & Todd, LLC

(57) ABSTRACT

An electrical terminal assembly includes a base having a body including a first end and a second end. First and second opposed base beams extend from the first end of the body in a first direction. A spring clamp has a clamp base and first and second opposed spring beams extending from the clamp base in the first direction and disposed over the first and second base beams biasing the first and second base beams toward one another. The body of the base is configured to permit the spring clamp to be inserted onto the base in a second direction normal the first direction.

18 Claims, 6 Drawing Sheets

(56) References Cited

U.S. PATENT DOCUMENTS

| | | | | | |
|---|---|---|---|---|---|
| 4,540,235 | A | * | 9/1985 | Lolic | 439/839 |
| 4,553,799 | A | | 11/1985 | Deters | |
| 4,553,808 | A | | 11/1985 | Weidler et al. | |
| 4,570,147 | A | | 2/1986 | Ebi | |
| 4,583,812 | A | | 4/1986 | Gross, Jr. et al. | |
| 4,646,052 | A | | 2/1987 | Matsunaga et al. | |
| 4,672,352 | A | | 6/1987 | Takano | |
| 4,751,490 | A | | 6/1988 | Hatagishi | |
| 4,842,534 | A | | 6/1989 | Mobley et al. | |
| 4,869,686 | A | | 9/1989 | Michaels et al. | |
| 4,869,972 | A | | 9/1989 | Hatagishi | |
| 4,871,990 | A | | 10/1989 | Ikeda et al. | |
| 4,932,877 | A | | 6/1990 | Zinn | |
| 4,941,851 | A | | 7/1990 | Hsueh | |
| 4,958,426 | A | | 9/1990 | Endo et al. | |
| 5,007,865 | A | | 4/1991 | Jakobeit | |
| 5,035,661 | A | | 7/1991 | Steinhardt et al. | |
| 5,088,940 | A | | 2/1992 | Saito | |
| 5,094,636 | A | | 3/1992 | Zinn et al. | |
| 5,147,230 | A | | 9/1992 | Plyler et al. | |
| 5,226,842 | A | | 7/1993 | Endo et al. | |
| 5,246,390 | A | | 9/1993 | Egenolf | |
| 5,288,252 | A | | 2/1994 | Steinhardt et al. | |
| 5,350,321 | A | | 9/1994 | Takenouchi | |
| 5,386,903 | A | | 2/1995 | Rothschild et al. | |
| 5,416,461 | A | | 5/1995 | Totsuka et al. | |
| 5,427,552 | A | | 6/1995 | Zielinski et al. | |
| 5,437,566 | A | | 8/1995 | Zinn et al. | |
| 5,474,475 | A | | 12/1995 | Yamaguchi | |
| 5,488,346 | A | | 1/1996 | Kondo et al. | |
| 5,573,434 | A | | 11/1996 | Ittah et al. | |
| 5,581,225 | A | | 12/1996 | Oh et al. | |
| 5,588,884 | A | * | 12/1996 | Rudoy et al. | 439/845 |
| 5,591,051 | A | | 1/1997 | Ittah | |
| 5,647,772 | A | | 7/1997 | Martucci et al. | |
| 5,658,174 | A | | 8/1997 | Benes et al. | |
| 5,662,487 | A | | 9/1997 | Okamura et al. | |
| 5,679,034 | A | | 10/1997 | Hanazaki et al. | |
| 5,716,245 | A | | 2/1998 | Kameyama et al. | |
| 5,739,741 | A | | 4/1998 | Hanazaki et al. | |
| 5,745,024 | A | | 4/1998 | Ohta et al. | |
| 5,795,193 | A | | 8/1998 | Yang | |
| 5,868,590 | A | | 2/1999 | Dobbelaere | |
| 5,886,611 | A | | 3/1999 | Schaller et al. | |
| 6,036,529 | A | | 3/2000 | Brown et al. | |
| 6,092,280 | A | | 7/2000 | Wojnarowski | |
| 6,126,495 | A | | 10/2000 | Lolic et al. | |
| 6,178,106 | B1 | | 1/2001 | Umemoto et al. | |
| 6,431,880 | B1 | | 8/2002 | Davis et al. | |
| 6,454,601 | B1 | | 9/2002 | Vaitkus et al. | |
| 6,506,060 | B2 | | 1/2003 | Sumida et al. | |
| 6,558,198 | B2 | | 5/2003 | Kobayashi et al. | |
| 6,648,674 | B1 | | 11/2003 | Dobler | |
| 6,722,926 | B2 | * | 4/2004 | Chevassus-More | 439/721 |
| 6,759,938 | B2 | | 7/2004 | Matsumura et al. | |
| 6,824,430 | B2 | | 11/2004 | Matsumura et al. | |
| 6,872,103 | B1 | | 3/2005 | Flieger et al. | |
| 7,071,808 | B2 | | 7/2006 | Nakamura | |
| 7,592,892 | B2 | | 9/2009 | Ito et al. | |
| 7,595,715 | B2 | | 9/2009 | Pavlovic et al. | |
| 7,612,647 | B2 | | 11/2009 | Onoda et al. | |
| 7,766,706 | B2 | * | 8/2010 | Kawamura et al. | 439/839 |
| 7,892,050 | B2 | | 2/2011 | Pavlovic et al. | |
| 8,128,441 | B2 | * | 3/2012 | Mukuno | 439/845 |
| 8,182,299 | B2 | | 5/2012 | Schrader | |
| 8,388,389 | B2 | * | 3/2013 | Costello et al. | 439/839 |
| 8,449,338 | B2 | * | 5/2013 | Gong et al. | 439/839 |
| 2004/0124963 | A1 | | 7/2004 | Nakamura | |
| 2006/0205267 | A1 | | 9/2006 | Darr et al. | |
| 2006/0223385 | A1 | | 10/2006 | Pavlovic et al. | |
| 2008/0224814 | A1 | | 9/2008 | Pavlovic et al. | |
| 2009/0085712 | A1 | | 4/2009 | Pavlovic et al. | |
| 2010/0323563 | A1 | | 12/2010 | Pavlovic et al. | |
| 2011/0076901 | A1 | * | 3/2011 | Glick et al. | 439/839 |
| 2011/0311286 | A1 | * | 12/2011 | Thayer et al. | 399/350 |
| 2012/0285720 | A1 | | 11/2012 | Chou | |
| 2014/0227913 | A1 | | 8/2014 | Natter | |
| 2014/0227915 | A1 | | 8/2014 | Glick et al. | |
| 2014/0273659 | A1 | | 9/2014 | Glick et al. | |

FOREIGN PATENT DOCUMENTS

| | | | |
|---|---|---|---|
| CN | 104051884 | A | 9/2014 |
| JP | 09147731 | | 6/1997 |
| JP | 2000133114 | A | 12/2000 |
| WO | 2012/069499 | A1 | 5/2012 |

OTHER PUBLICATIONS

Chinese 2nd Office Action, Application No. 201010203667.3 dated Jul. 17, 2014.

* cited by examiner

ELECTRICAL TERMINAL ASSEMBLY

CROSS-REFERENCE TO RELATED APPLICATIONS

This application claims the benefit of U.S. Provisional Application No. 61/860,991, filed Aug. 1, 2013, the disclosure of which is incorporated herein by reference.

BACKGROUND OF THE INVENTION

This invention relates in general to electrical terminals such as for use in high power vehicle electrical connectors. Electrical connectors commonly include a body having a nonconductive housing encasing a conductive set of female electrical terminals. The female terminals are each connected to a respective end of a wire connector or fuse element retained in the housing for completing an electrical circuit. The female terminals are inserted over a set of male blade terminals. For example, the male blade terminals may be housed in another connector housing, such as for example, a power distribution box. The female terminals are typically designed with a spring-type feature to maintain a strong electrical contact with the outer surface of the male terminal blades.

Copper has good electrical conductivity properties and has been a preferred material for terminals, even though it is relatively expensive. However, copper is susceptible to relaxation (i.e., loss of spring force) as the temperature of the copper material increases. Since the temperature of the terminals increases as the current drawn in the electrical circuit increases, copper terminals have a reduced ability to maintain strong clamping force onto the male terminal blades. Relaxation of the female terminals may decrease the overall contact area with the male blades, resulting in reduced electrical conductivity, increased resistance, and a further increase in temperature.

It is desirable to keep the overall size of an electrical distribution box or other connectors as small as possible, while still providing the necessary current-carrying capacity. In some situations, the spring force cannot be further increased by simply making the terminals thicker or wider. When copper is used, the size limitations may make the desired spring force unattainable.

Some conventional electrical terminals have a two-piece configuration such that a copper base is used for providing the electrical communication with a wire connector. The base includes a plurality of fingers or beams which mechanically and electrically engage with a male terminal. A spring clamp is disposed over the plurality of beams of the base such that a compressive force biases the beams in an inward direction against the male terminal. The spring clamp is made of a suitable material, such as steel, having a high yield strength or spring-like quality. The material of the spring clamp retains its spring like qualities over a relatively large temperature range, which is ideal for high power applications, such as within electric or hybrid vehicles. However, it is desirable to mount the spring clamp onto the base such that undue stress or deformation is applied to the base and/or spring clamp during the assembly process.

SUMMARY OF THE INVENTION

This invention relates to electrical terminals and, in particular, to an electrical terminal assembly including a base having a body including a first end and a second end. First and second opposed base beams extend from the first end of the body in a first direction. A spring clamp has a clamp base and first and second opposed spring beams extending from the clamp base in the first direction and disposed over the first and second base beams, biasing the first and second base beams toward one another. The body of the base is configured to permit the spring clamp to be inserted onto the base in a second direction normal the first direction.

The invention also relates to a method of assembling an electrical terminal assembly including the steps of providing a base including a plurality of opposed base beams extending in a first direction, providing a spring clamp including a plurality of opposed spring beams extending in the first direction, and positioning the spring clamp over the base by moving the spring clamp in a lateral direction normal to the first direction until the spring beams are positioned over the base beams, thereby assembling the electrical terminal assembly.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
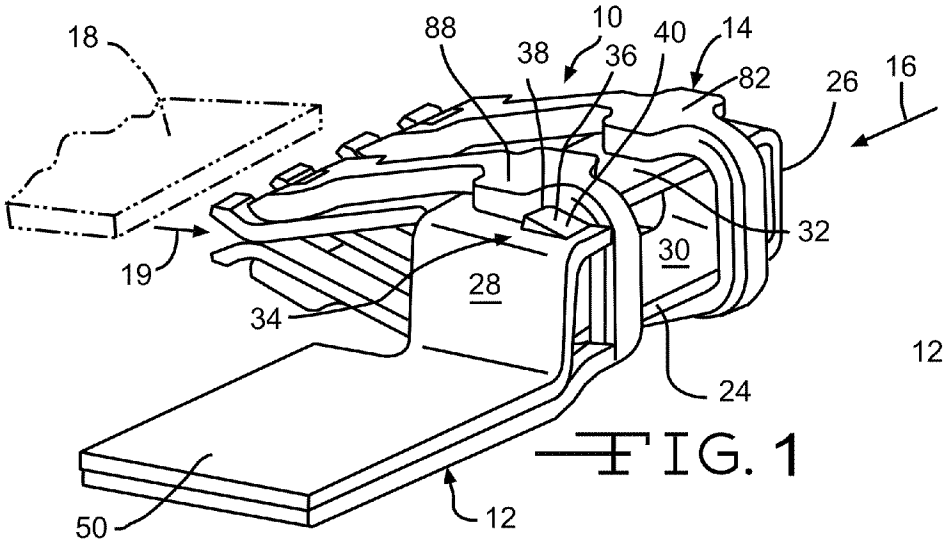
FIG. 1 is a perspective view of a first embodiment of an electrical terminal assembly.

Referring now to the drawings, there is illustrated in FIGS. 1 through 4 a first embodiment of an electrical terminal assembly, indicated generally at 10. The electrical terminal assembly 10 includes a base, indicated generally at 12, and a spring clamp, indicated generally at 14. In an assembled condition of the electrical terminal assembly 10, the spring clamp 14 is inserted over the base 12, as shown in FIG. 1. It should be understood that the base 12 and the spring clamp 14 may be shaped other than shown in the figures. As will be described below, the spring clamp 14 is preferably assembled or mounted on the base 12 along an assembly direction 16 in a side loaded manner (from a side of the base) to form the electrical terminal assembly 10.

The electrical terminal assembly 10 is used to make an electrical connection with an electrical connector, such as a male terminal blade, indicated by broken lines 18, as shown in FIG. 1. The blade 18 is inserted into the electrical terminal assembly 10 along an insertion direction 19 which is normal to the assembly direction 16. The electrical terminal assembly 10 may be inserted, molded into, or otherwise secured to a plastic body of a connector (not shown). The connector may include multiple electrical terminal assemblies 10 mounted therein. The electrical terminal assembly 10 is well suited for use in high power distribution boxes used in automotive vehicles.

The base 12 may be formed from a single metallic blank which is stamped and formed into the configuration shown in FIGS. 1 through 5. Similarly, the spring clamp 14 may also be formed from a single metallic blank which is stamped and formed into the configuration shown in FIGS. 1 through 4 and 6. The base 12 is preferably made of an electrically conductive material such as a copper alloy or an aluminum alloy. As will be explained below, the spring clamp 14 generally is provided to assist in forcing or pushing electrical contact engagement surfaces of the base 12 against the blade 18. Therefore, the spring clamp 14 is preferably made of a material, such as stainless steel, having a relatively high yield strength or spring-like quality. Preferably, the material of the spring clamp 14 can retain its spring-like qualities over a relatively large temperature range, which can act on the electrical terminal assembly 10 in high power applications, such as within electric or hybrid vehicles.

Figures 5, 6:
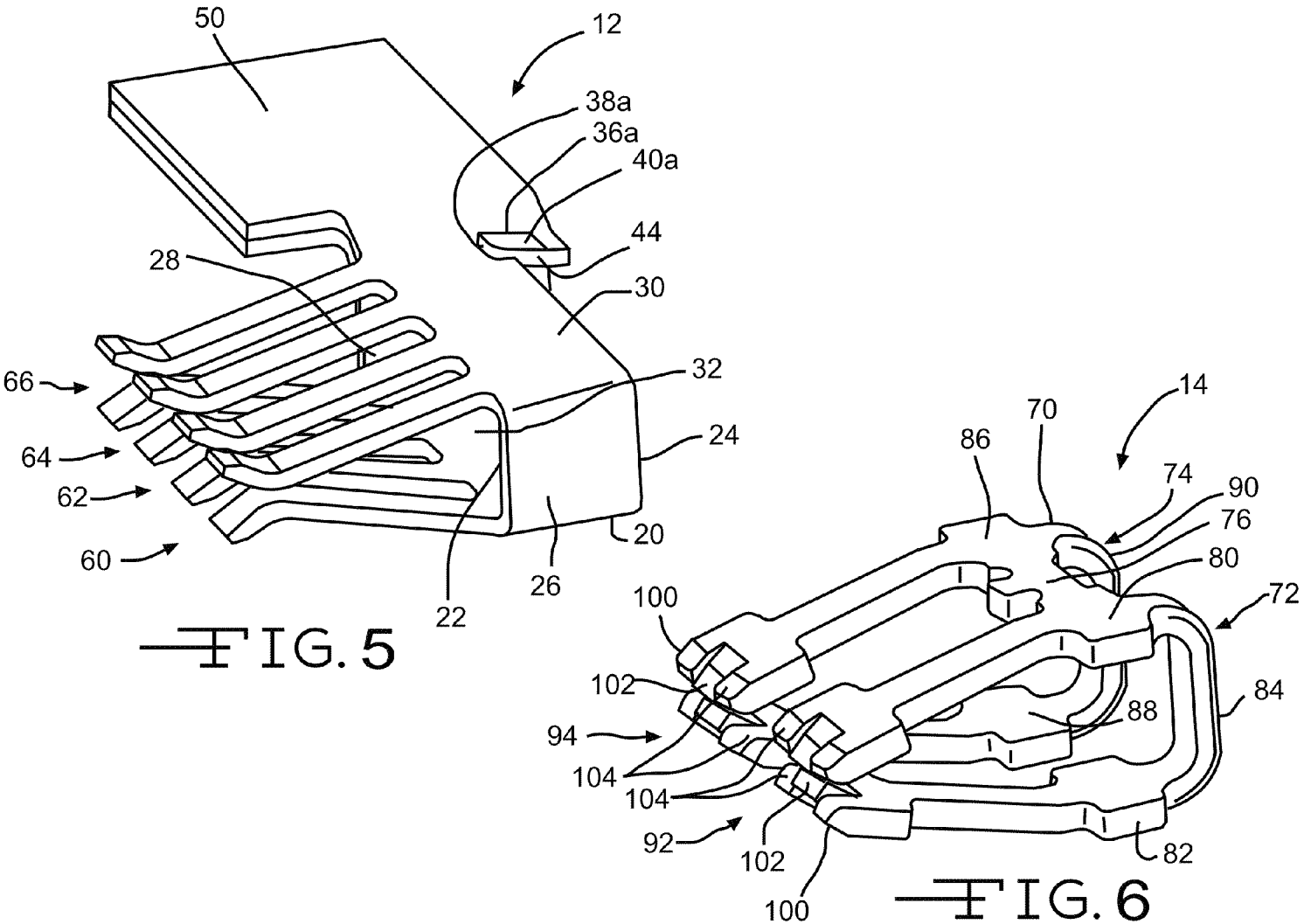
FIG. 5 is a perspective view of the base of the electrical terminal assembly of FIG. 1.
FIG. 6 is a perspective view of the spring clamp of the electrical terminal assembly of FIG. 1.

As shown in FIG. 5, the base 12 includes a box-shaped body 20 defining a front end 22, a rear end 24, and a pair of side walls 26 and 28. In the illustrated embodiment, the front end 22 and the rear end 24 are open such that they do not have solid wall portions formed from folded portions of the blank. It should be understood that the front end 22 and rear end 24 may include wall portions (not shown) if so desired. The body 20 further defines an upper plate 30 that is spaced from a lower plate 32. The upper and lower plates 30 and 32 extend from the front end 22 to the rear end 24.

As best shown in the bottom perspective view of FIG. 1, the body 20 includes a locking feature, indicated generally at 34, which helps secure the spring clamp 14 after assembly onto the base 12 and helps prevents movement of the spring clamp 14 relative to the base 12 in the insertion direction 19, as will be discussed in detail below. The locking feature 34 includes a tab 36 extending outwardly from the lower plate 32 which engages with a portion of the spring clamp 14 at an edge 38 of the tab 36. The tab 36 includes a sloped surface 40 rising in height as moving in a direction opposite to the insertion direction 19 along the surface of the lower plate 32. Similarly, the upper plate 30, as shown in FIG. 5, may include a tab **36*a* which engages with a portion of the spring clamp 14 at an edge 38*a* of the tab 36*a*. The tab 36*a* includes a sloped surface 40*a* rising in height as moving in the direction opposite the insertion direction 19 along the surface of the upper plate 30. The tabs 36 and 36*a* may be created using a cutting and/or lancing operation. For example, a U-shaped cut may be sheared into the upper and lower plates 30 and 32. The material within the U-shaped cut is punched outwardly, leaving the tabs 36*a* and 36 attached to the upper and lower plates 30 and 32. During assembly, the tabs 36 and 36*a* may be resilient such that they deflect by a relatively small amount when the spring clamp 14 is mounted onto the base 12. Alternatively, the material of the base 12 may have sufficient strength such that the tabs 36 and 36*a*** are not deflected during the assembly process.

The locking feature 34 may also be defined by notches or other features formed in the base 12 which interact with the spring clamp 14 to prevent the movement of the spring clamp 14 relative to the base 12 in the assembly direction 16. For example, the rear end 24 of the upper plate 30 and the lower plate 32 may be notched so as to form ledges or stops 44 therein, which function as stops to prevent lateral movement of the spring clamp 14 relative to the base 12 in the insertion direction 16. As will be discussed below, the spring clamp 14 is inserted onto the base 12 along the insertion direction 16 until the spring clamp 14 contacts the stops 44. If desired, the base 12 and/or the spring clamp 14 may be formed with additional features which help prevent the spring clamp 14 from moving in the direction opposite the insertion direction once the spring clamp 14 is fully inserted onto the base 12.

The base 12 further includes a terminal plate 50 extending outwardly from the side wall 28. The terminal plate 50 is used to connect with an end of a wire conductor (not shown). The end of the wire conductor may be welded, soldered, or otherwise connected to a flat surface of the terminal plate 50 to provide electrical communication between the wire conductor and the base 12. The terminal plate 50 can have any shape or configuration suitable for connecting to the end of the wire connector. As shown in FIG. 1, the terminal plate 50 is formed from a pair of relatively thin strip portions of the blank that are folded against one another. The terminal plate 50 may extend outwardly from the body 20 in any direction.

Extending from the front end 22 of the body 20 are a plurality of elongated fingers or base beams which engage the blade 18 to complete an electrical connection between the base 12 and the blade 18. In the embodiment shown, the base 12 includes four pairs of opposed base beams, indicated generally at 60, 62, 64, and 66, extending outwardly from the front end 22 of the body 20 in a direction opposite to the insertion direction 19. Each pair of base beams 60, 62, 64, and 66 includes a first base beam extending from the upper plate 30 and a second base beam extending from the lower plate 32. The base beams are resilient such that each base beam from the pair of base beams 60, 62, 64, and 66 will move outwardly from one another to receive the blade 18 when inserted therebetween. The base beams provide electrical contact with the blade 18.

Referring to FIG. 6, the spring clamp 14 has body 70 defining a first U-shaped clamp base 72 and a second U-shaped clamp base 74. The first and second clamp bases 72 and 74 may be integrally formed together by a bridge 76. The first clamp base 72 includes an upper pad 80, a lower pad 82, and a U-shaped strut 84 connecting the upper and lower pads 80 and 82 together. Similarly, the second clamp base 74 includes an upper pad 86, and lower pad 88, and a strut 90 connecting the upper and lower pads 86 and 88 together. The upper pads 80 and 86 are positioned against the upper plate 30 of the base 12. The lower pads 82 and 88 are positioned against the lower plate 32 of the base 12. The bridge 76 is attached to the upper pads 80 and 86. The pads 80, 82, 86, and 88 may be wider than the struts 84 and 90 to provide stability of the spring clamp 14 on the base 12. The struts 84 and 90 may be thinner than the pads 80, 82, 86, and 88 to reduce material and weight.

The spring clamp 14 further includes a pair of opposed spring beams, indicated generally at 92 and 94. The pair of spring beams 92 extends outwardly opposite the insertion direction 19 from the upper and lower pads 80 and 82 of the first clamp base 72. The pair of spring beams 94 extends outwardly opposite the insertion direction 19 from the upper and lower pads 86 and 88 of the second clamp base 74. The opposed spring beams are resilient such that each of the spring beams from the pair of spring beams 92 and 94 may move outwardly from one another. The pair of spring beams 92 and 94 bias the opposed base beams of the pairs of the base beams 60, 62, 64, and 66 toward one another, thereby providing a clamping force. Each one of the pair of spring beams 92 and 94 provides a clamping bias force for two pairs of base beams 60, 62, 64, and 66 as shown in FIGS. 1 through 4.

As shown in FIG. 6, each of the spring beams of the pair of spring beams 92 and 94 include an end portion 100 having an extension 102 formed between a pair of wing portions 104. Opposed extensions 102 extend inwardly toward one another and are positioned between adjacent base beams of the pairs of base beams 60, 62, 64, and 66 during final assembly of the electrical terminal assembly 10. This configuration helps prevent lateral movement of the spring beams relative to the base beams such that the biasing force of the spring beams is uniform.

Figure 7:
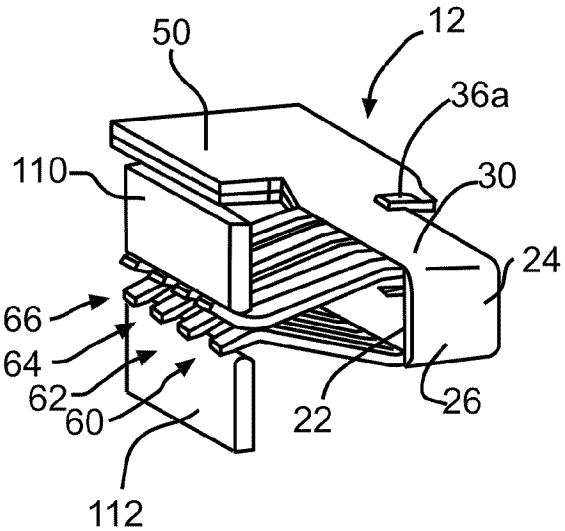
FIG. 7 is a schematic perspective view illustrating a first step in assembling the spring clamp onto the base of the electrical terminal assembly of FIG. 1.

FIGS. 7 through 11 illustrate a method of assembling the electrical terminal assembly 10. As will be described below, the spring clamp 14 may be "side loaded" onto the base 12 in the assembly direction 16. As shown in FIG. 7, the ends of the opposed pairs of base beams 60, 62, 64, and 66 may initially be moved toward one another or held in position against one another by a pair of holding arms 110 and 112. The holding arms 110 and 112 are schematically shown in FIG. 7 and may be portions of a tool (not shown) to assist in the assembly of the electrical terminal assembly 10 by selectively moving the holding arms away and toward one another. It should be understood that this initial operation of positioning the base beams 60, 62, 64, and 66 may be optional. However, use of the holding arms 110 and 112 helps protect the base beams from inadvertent deflection during the assembly process and also properly positions any misaligned base beams that may have been deflected out of position.

Figure 9:
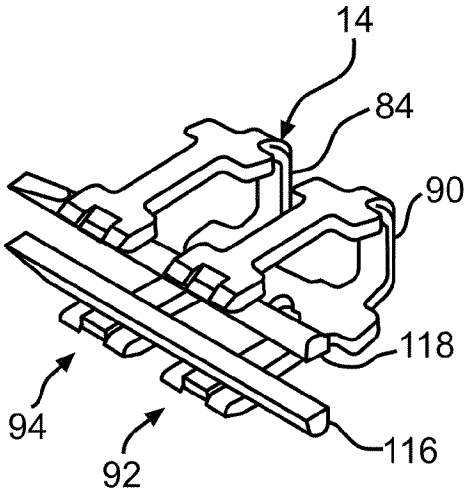
FIG. 9 is a schematic perspective view illustrating a third step in assembling the spring clamp onto the base of the electrical terminal assembly of FIG. 1.
Figure 8:
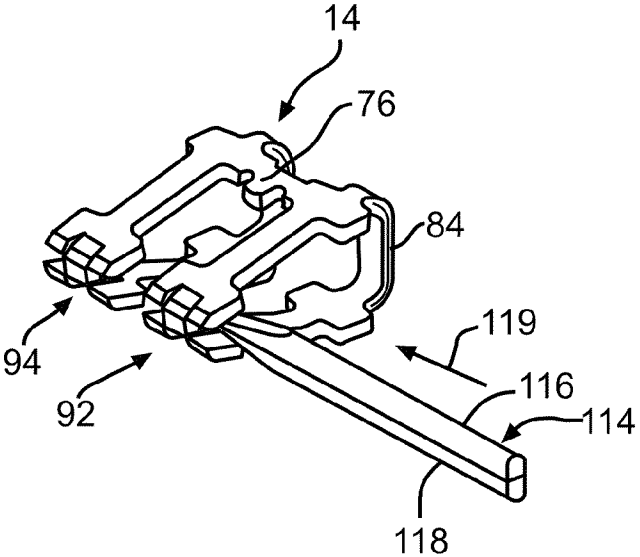
FIG. 8 is a schematic perspective view illustrating a second step in assembling the spring clamp onto the base of the electrical terminal assembly of FIG. 1.
Figure 11:
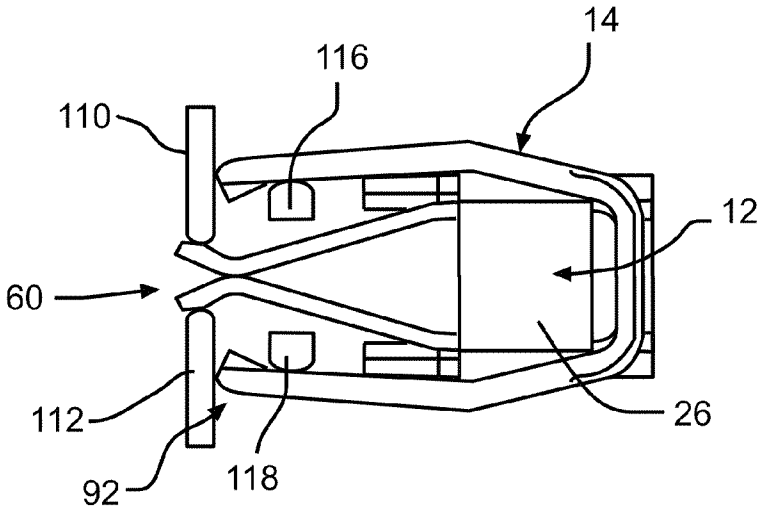
FIG. 11 is a side view of the electrical terminal assembly in the fourth step schematically illustrated in FIG. 10.
Figure 10:
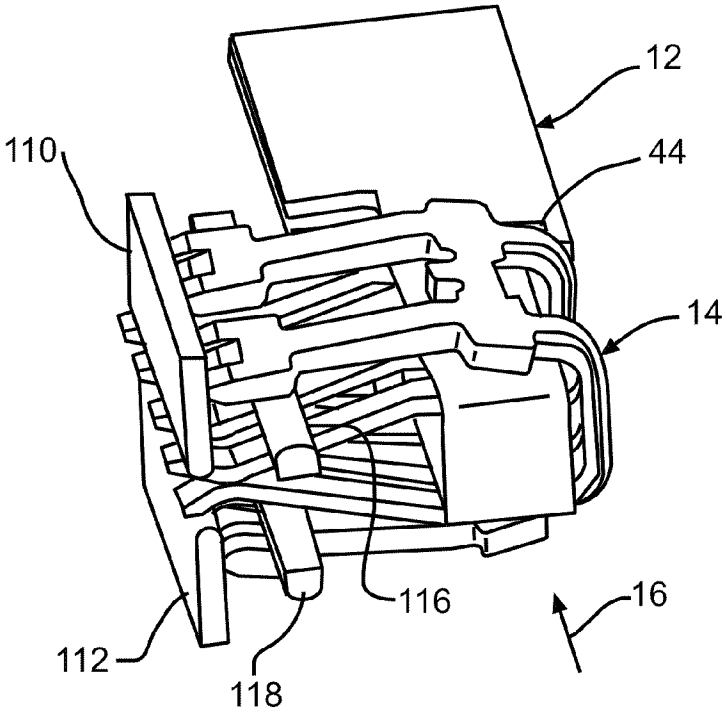
FIG. 10 is a schematic perspective view illustrating a fourth step in assembling the spring clamp onto the base of the electrical terminal assembly of FIG. 1.

As schematically show in FIG. 8, a split arbor tool 114 may be used to position the opposed pair of spring beams 92 and 94 in a spread apart manner, as shown in FIG. 9. Note that FIG. 9 is a bottom perspective view of the spring clamp 14 having a different viewpoint than FIG. 8. Referring back to FIG. 8, the split arbor tool 114 includes an elongated first arbor 116 and an elongated second arbor 118. Initially, the first and second arbors 116 and 118 are positioned adjacent one another to provide a low profile, as shown in FIG. 8. The split arbor tool 114 is then moved in a lateral direction 119 (parallel to the assembly direction 16) until they are positioned between the pairs of opposed spring beams 92 and 94. The first and second arbors 116 and 118 are then moved away from each other to spread apart each pair of spring beams 92 and 94, as shown in FIG. 9. Thus, the movement of the split arbor tool 114 overcomes the biasing spring force which maintains the opposed spring beams 92 and 94 toward one another. The spread apart spring clamp 14 may then be "side loaded" or moved over the base 12, as shown in FIGS. 10 and 11. The spring clamp 14 is moved in the lateral assembly direction 16 until the spring clamp 14 engages with the stops 44. The first and second arbors 116 and 118 may then be withdrawn to permit the opposed spring arms 92 and 94 to be positioned onto respective pairs of base beams 60, 62, 64, and 66, as shown in FIG. 1. If desired, the first and second arbors 116 and 118 may be moved closer to one another prior to withdrawal preferably in a manner that will not damage the base beams 60, 62, 64, and 66. The holding arms 110 and 112 may be removed prior to or after withdrawal of the first and second arbors 116 and 118.

Figure 2:
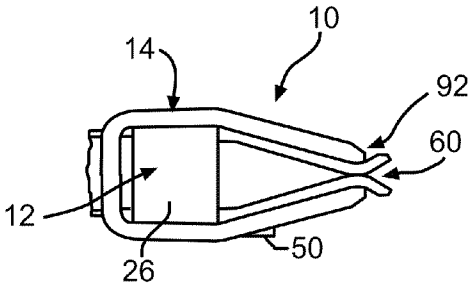
FIG. 2 is an elevational end view of the electrical terminal assembly of FIG. 1.
Figure 3:
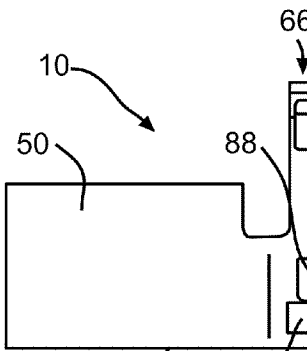
FIG. 3 is a bottom view of the electrical terminal assembly of FIG. 1.
Figure 4:
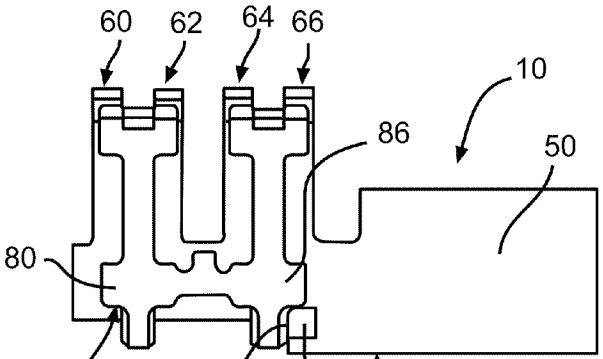
FIG. 4 is a top plan view of the electrical terminal assembly of FIG. 1.

It should be understood that the tips of the opposed base beams in the relaxed state may be touching one another, as best shown in FIG. 2, or may be configured to have a gap therebetween. If a gap is present, the holding arms 110 and 112 may be used to move the tips of the base beams together during the assembly process to assist in providing clearance for the first and second arbors, as shown in FIG. 11.

The dimensions of the spring clamp 14 and the base 12 may be configured such that when the spring clamp 14 is inserted into position on the base 12, the pad 88 slides along the edge 38 of the tab 36, and the pad 86 slides along the edge **38*a* of the tab 36*a* to provide a tight but slight interference fit to help secure the spring clamp 14 onto the base 12**.

Because of the side loaded assembly as described above, the base 12 may have a relatively short depth compared to conventional electrical terminal assemblies, such as those disclosed in U.S. Pat. No. 8,366,497, which is hereby incorporated by reference herein. U.S. Pat. No. 8,366,497 discloses a front loaded assembled electrical terminal assembly such that the spring clamp is inserted onto the base in the opposite direction from the assembly direction 16. Although the dimension of the spring clamp 14 may be the same as compared to conventional spring clamps, such as those disclosed in U.S. Pat. No. 8,366,497, the depth of the base 12 may be significantly reduced, thereby providing an electrical terminal assembly 10 requiring less packaging depth.

Figure 12:
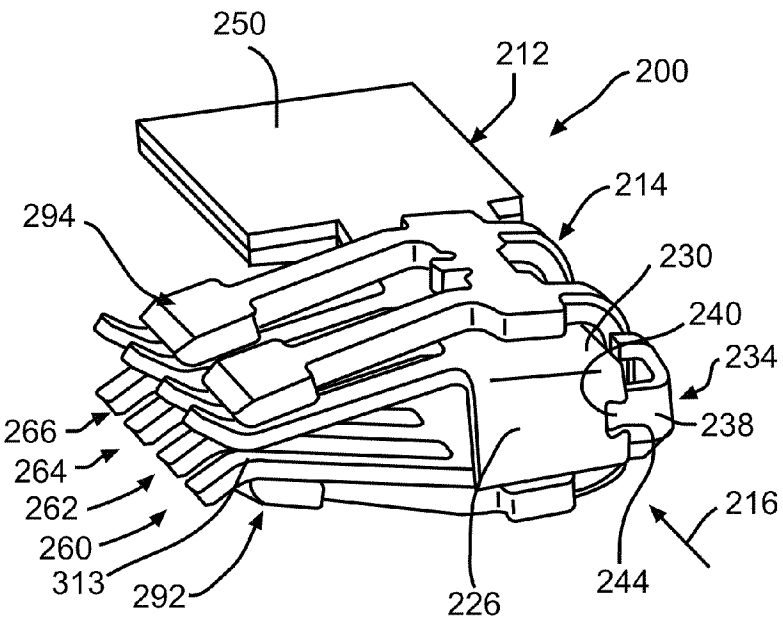
FIG. 12 is a perspective view of a second embodiment of an electrical terminal assembly.

There is illustrated in FIG. 12 a second embodiment of an electrical terminal assembly, indicated generally at 200. The electrical terminal assembly 200 is similar in structure and function as the electrical terminal assembly 10. Thus, features of the electrical terminal assembly 200 that are similar to the features of the electrical terminal assembly 10 will be identified with reference numbers that are incremented by 200. The electrical terminal assembly 200 includes a base, indicated generally at 212, and a spring clamp, indicated generally at 214. In an assembled condition of the electrical terminal assembly 200, the spring clamp 214 is inserted over the base 212, as shown in FIG. 12. As will be described below, the spring clamp 214 is preferably assembled or mounted on the base 212 along an assembly direction 216 in a side loaded manner (from a side of the base 212) to form the electrical terminal assembly 200.

Figure 13:
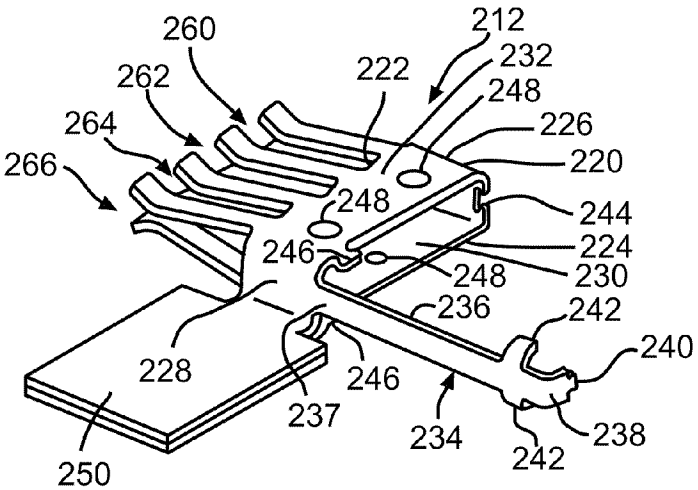
FIG. 13 is a perspective view of the base of the electrical terminal assembly of FIG. 1 shown in a pre-assembled position.

The base 212 may be formed from a single metallic blank which is stamped and formed into the configuration shown in FIG. 13. Similarly, the spring clamp 214 may also be formed from a single metallic blank which is stamped and formed into the configuration shown in FIG. 14. The base 212 is preferably made of an electrically conductive material, such as a copper alloy or an aluminum alloy. As will be explained below, the spring clamp 214 generally is provided to assist in forcing or pushing electrical contact engagement surfaces of the base 212 against a connector or blade (not shown). Therefore, the spring clamp 214 is preferably made of a material, such as stainless steel, having a relatively high yield strength or spring-like quality. Preferably, the material of the spring clamp 214 can retain its spring-like qualities over a relatively large temperature range, which can act on the electrical terminal assembly 200 in high power applications, such as within electric or hybrid vehicles.

As shown in the bottom view of FIG. 13, the base 212 includes a box-shaped body 220 defining a front end 222, a rear end 224, and a pair of side walls 226 and 228. In the illustrated embodiment, the front end 222 and the rear end 224 are open such that they do not have solid wall portions formed from folded portions of the blank. It should be understood that the front end 222 and the rear end 224 may include wall portions (not shown) if so desired. The body 220 further defines an upper plate 230 spaced from a lower plate 232. The upper and lower plates 230 and 232 extend from the front end 222 to the rear end 224.

The body 220 may include an integrally formed locking feature, indicated generally at 234, which helps secure the removal of the spring clamp 214 after assembly onto the base 212 and helps to prevent movement of the spring clamp 214 relative to the base 212 in a direction lateral to the assembly direction 216. The locking feature 234 includes an elongated belt or latch 236. The latch 236 has a first end 237 that is hingedly connected to the side wall 226 by simply bending or deflecting the first end 237 of the latch 236 adjacent the side wall 228. The latch 236 includes a curved second end 238 which includes a tab 240 extending from the second end 238. The second end 238 of the latch 236 also includes a pair of bosses 242 extending therefrom in a direction parallel with the tab 240. During assembly, as will be discussed below, the tab 240 is inserted into a recess or slot 244 formed in the side wall 226 of the body 220. The body 220 may further include integrally formed stop members 246 extending from the upper and lower plates 230 and 232 at the rear end 224.

The upper and lower plates 230 and 232 may include optional dome shaped protrusions 248 formed therein. The protrusions 248 extend outwardly from the upper and lower plates 230 and 232. The protrusions 248 assist in frictionally holding the spring clamp 214 to the base 212 if configured with a slight interference fit. The protrusions 248 may function as contact points which reduce rattling of the spring clamp 214 relative to the base 212. The protrusions 248 may also help reduce scratching of the contacting surfaces of the base 212 when the spring clamp 214 is slid into position during assembly of the electrical terminal assembly 200. Severe scratching or etching of the base 212 is undesirable.

The base 212 further includes a terminal plate 250 extending outwardly from the side wall 228. The terminal plate 250 is used to connect with an end of a wire conductor (not shown). Extending from the front end 222 of the body 220 are a plurality of elongated fingers or base beams which engage the connector or blade to complete an electrical connection between the base 212 and the blade 218. In the embodiment shown, the base 212 includes four pairs of opposed base beams, indicated generally at 260, 262, 264, and 266, extending outwardly from the front end 222 of the body 220. Each pair of base beams 260, 262, 264, and 266 includes a base beam extending from the upper plate 230 and a base beam extending from the lower plate 232. The base beams are resilient such that each base beam from the pair of base beams 260, 262, 264, and 266 will move outwardly from one another to receive the connector or blade when inserted therebetween.

Figure 14:
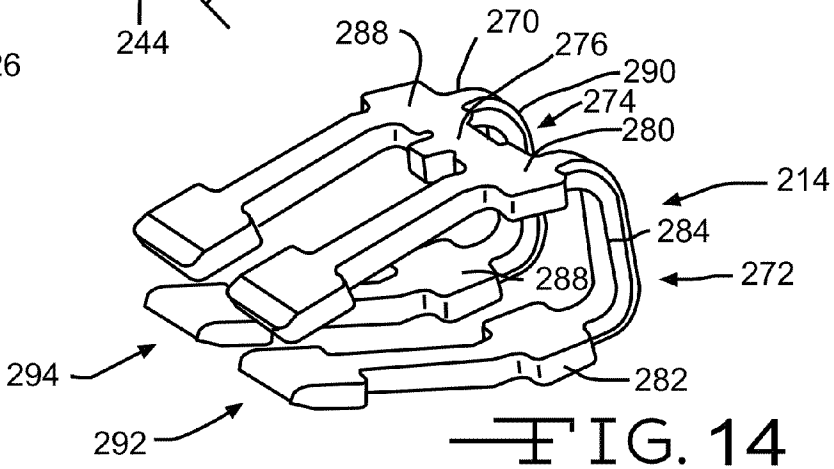
FIG. 14 is a perspective view of the spring clamp of the electrical terminal assembly of FIG. 1.

Referring to FIG. 14, the spring clamp 214 has a body 270 defining a first U-shaped clamp base 272 and a second U-shaped clamp base 274. The first and second clamp bases 272 and 274 may be integrally formed together by a bridge 276. The first clamp base 272 includes an upper pad 280, a lower pad 282, and a U-shaped strut 284 connecting the upper and lower pads 280 and 282 together. Similarly, the second clamp base 274 includes an upper pad 286, and lower pad 288, and a strut 290 connecting the upper and lower pads 286 and 288 together. The upper pads 280 and 286 are positioned against the upper plate 230 of the base 212. The lower pads 282 and 288 are positioned against the lower plate 232 of the base 212. The bridge 276 is attached to the upper pads 280 and 286. The pads 280, 282, 286, and 288 may be wider than the struts 284 and 290 to provide stability of the spring clamp 214 on the base 212. The struts 284 and 290 may be thinner than the pads 280, 282, 286, and 288 to reduce material and weight.

The spring clamp 214 further includes a pair of opposed spring beams, indicated generally at 292 and 294. The pair of spring beams 292 extends outwardly from the upper and lower pads 280 and 282 of the first clamp base 272. The pair of spring beams 294 extends outwardly from the upper and lower pads 286 and 288 of the second clamp base 274. The opposed spring beams 292 and 294 are resilient such that each of the spring beams from the pair of spring beams 292 and 294 may move outwardly from one another. The pair of spring beams 292 and 294 bias the opposed base beams of the pairs of the base beams 260, 262, 264, and 266 toward one another, thereby providing a clamping force. Each one of the pair of spring beams 292 and 294 provides a clamping bias force for two pairs of base beams 260, 262, 264, and 266 as shown in FIG. 12. Unlike the spring clamp 14 described above, however, the spring clamp 214 does not include extensions to help prevent lateral movement of the spring beams relative to the base beams.

Figure 16:
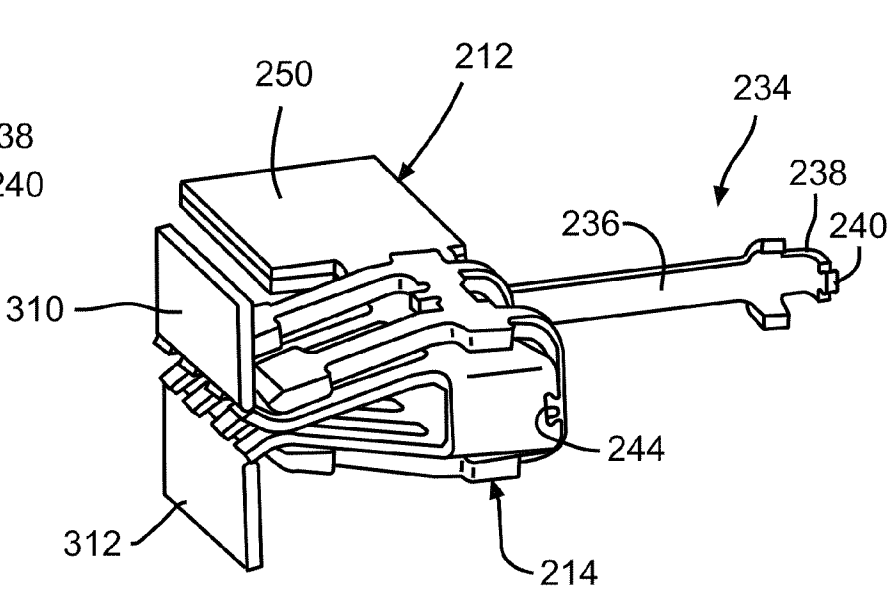
FIG. 16 is a schematic perspective view illustrating a second step in assembling the spring clamp onto the base of the electrical terminal assembly of FIG. 12.
Figure 15:
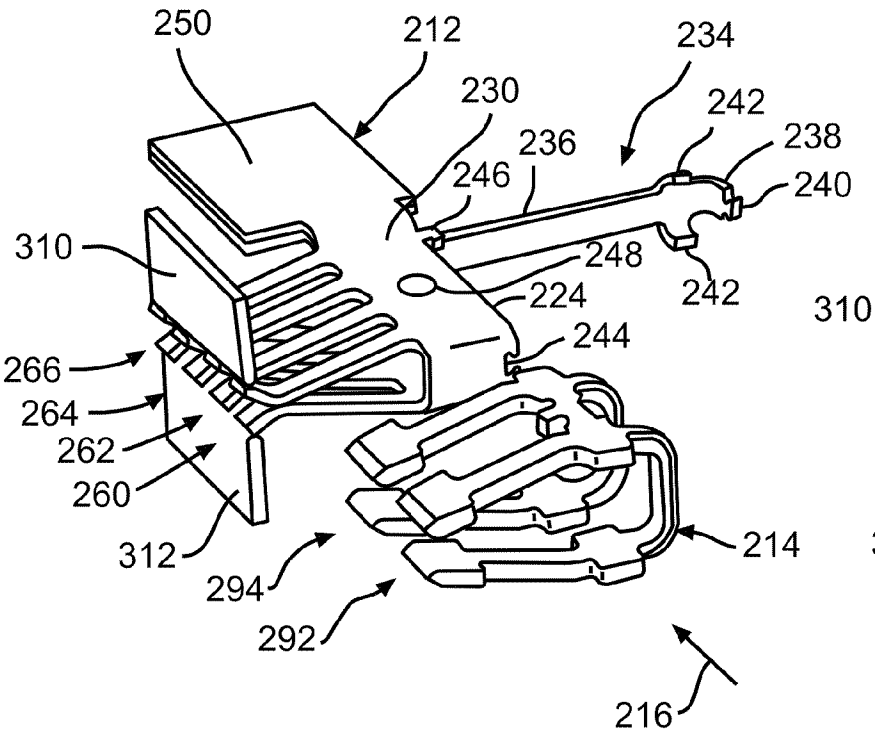
FIG. 15 is a schematic perspective view illustrating a first step in assembling the spring clamp onto the base of the electrical terminal assembly of FIG. 12.

FIGS. 15 and 16 illustrate a method of assembling the electrical terminal assembly 200. As will be described below, the spring clamp 214 may be "side loaded" onto the base 212 in the assembly direction 216. As shown in FIG. 15, the ends of the opposed pairs of base beams 260, 262, 264, and 266 may be moved toward one another by a pair of holding arms 310 and 312. The holding arms 310 and 312 are schematically shown in FIGS. 15 and 16 and may be portions of a tool to assist in the assembly of the electrical terminal assembly 200 by selectively moving the holding arms 310 and 312 away and toward one another. Note that the use of the holding arms 310 and 312 pushes the tips of the base beams together, thereby closing off any gap 313 between them, as is shown in FIG. 12. It should be understood that this initial operation of positioning the base beams 260, 262, 264, and 266 may be optional. However, use of the holding arms 310 and 312 helps protect the base beams from inadvertent deflection during the assembly process and also properly positions any misaligned base beams that may have been deflected out of position.

The spring clamp 214 can then be side loaded in the assembly direction 216 over and onto the base 212 until the spring clamp 214 contacts the stops 246. Note that the absence of any extensions of the end portions of the spring beams 292 and 294 provides a relatively smooth surface that can glide across the base beams 260, 262, 264, and 266. Thus, an arbor tool may not be necessary to spread apart the spring beams 292 and 294. The holding arms 310 and 312 may then be removed, thereby permitting the opposed spring beams to spread apart forming gaps 313 until the base beams engage with the spring beams 292 and 294.

To secure the spring clamp 214 relative to the base 212, the latch 236 can be bent at the first end 237 and pivoted such that the second end 238 is positioned adjacent the rear end 224. The tab 240 may then be inserted and retained in the slot 244. The tab 240 and the slot 244 can be configured having a dovetail shape configuration to prevent the tab 240 from being pulled out of the slot 244. The now-locked latch 236 helps prevent the spring clamp 214 from being moved relative to the base 212. The presence of the latch 236 traps and prevents the spring clamp 214 from moving in a forward or rearward direction (normal to the assembly direction 216. Additionally, the spring clamp 214 is prevented from moving in lateral directions parallel to the assembly direction 216 by the struts 284 and 290 being trapped between the stops 246 and the bosses 242 formed on the latch 236.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical terminal assembly comprising:

a base including a body having a first end and a second end, wherein first and second opposed base beams extend from the first end of the body in a first direction; and a spring clamp having a clamp base and first and second opposed spring beams extending from the clamp base in the first direction and disposed over the first and second base beams so as to bias the first and second base beams toward one another, wherein the body of the base is configured to permit the spring clamp to be inserted onto the base in a second direction that is normal to the first direction.

2. The electrical terminal assembly of claim 1, wherein the spring clamp is resiliently configured such that the first and second spring beams may be deflected away from one another, permitting the spring clamp to be moved over the body of the base along the second direction during an assembly process of the electrical terminal assembly.

3. The electrical terminal assembly of claim 1, wherein the base includes an integrally formed locking feature that prevents the removal of the spring clamp from the base along the second direction.

4. The electrical terminal assembly of claim 3, wherein the locking feature further prevents movement of the spring clamp relative to the base in a lateral direction that is normal to the first direction.

5. The electrical terminal assembly of claim 4, wherein the locking feature is an outwardly extending tab that engages with the spring clamp.

6. The electrical terminal assembly of claim 3, wherein the locking feature is an elongated latch that traps portions of the spring clamp between the latch and a rear end of the body of the base.

7. The electrical terminal assembly of claim 6, wherein the latch includes a tab extending from an end of the latch, and wherein the tab is disposed in a slot formed in the rear end of the body of the base, thereby securing the end of the latch to the rear end of the body.

8. The electrical terminal assembly of claim 7, wherein the latch includes a boss formed therein and positioned adjacent the spring clamp to prevent movement of the spring clamp in the second direction.

9. The electrical terminal assembly of claim 1, wherein the base includes one or more dome shaped protrusions that engage with surfaces of the spring clamp.

10. The electrical terminal assembly of claim 1, wherein the spring clamp is made of a material having a higher yield strength than a material that the base is made of.

11. The electrical terminal assembly of claim 1, wherein the spring clamp is made of steel.

12. The electrical terminal assembly of claim 1, wherein the base is made of a high conductivity alloy.

13. A method of assembling an electrical terminal assembly comprising the steps of:

(a) providing a base including a plurality of opposed base beams extending in a first direction;

(b) providing a spring clamp including a plurality of opposed spring beams extending in the first direction; and (c) positioning the spring clamp over the base by moving the spring clamp in a lateral direction normal to the first direction until the spring beams are positioned over the base beams, thereby assembling the electrical terminal assembly.

14. The method of claim 13, wherein prior to step (c), opposed spring beams are deflected and spring biased away from one another to provide clearance for insertion of the spring clamp over the base.

15. The method of claim 14, wherein the opposed spring beams are deflected by an arbor tool having first and second arbors that are movable relative to one another.

16. The method of claim 15, wherein subsequent to step (c), the first and second arbors are retracted from the spring beams.

17. The method of claim 13, wherein prior to step (c), tips of opposed base beams are moved toward one another.

18. The method of claim 17, wherein the tips of the opposed base beams are moved toward one another by the use of a holding tool having a pair or arms which are movable relative to one another.

* * * * *